United States Patent [19]

Dey

[11] 4,071,748

[45] Jan. 31, 1978

[54] LIGHTING PANEL WITH CONTROLLED DISTRIBUTION OF POLARIZED LIGHT

[75] Inventor: Thomas W. Dey, Rochester, N.Y.

[73] Assignee: Bausch & Lomb Incorporated, Rochester, N.Y.

[21] Appl. No.: 671,900

[22] Filed: Mar. 29, 1976

Related U.S. Application Data

[63] Continuation-in-part of Ser. No. 542,526, Jan. 20, 1975.

[51] Int. Cl.[2] ..... F21V 9/14; F21V 5/00

[52] U.S. Cl. ..... 362/19; 362/333

[58] Field of Search ..... 240/9, 9.5, 51.11 R, 240/106 R, 106.1, 106 B

[56] References Cited

U.S. PATENT DOCUMENTS

| | | | |
|---|---|---|---|
| 3,124,310 | 3/1964 | Lipscomb | 240/78 LK |
| 3,179,797 | 4/1965 | Franck | 240/106 R |
| 3,213,753 | 10/1965 | Rogers | 240/9.5 X |
| 3,234,376 | 2/1966 | Ceglia | 240/106 R |
| 3,721,818 | 3/1973 | Stahlhut | 240/51.11 R X |
| 3,876,285 | 4/1975 | Schwarzmüller | 240/9.5 X |
| 3,912,921 | 10/1975 | Howe et al. | 240/9.5 |

*Primary Examiner*—Donald A. Griffin

*Attorney, Agent, or Firm*—Frank C. Parker; Bernard D. Bogdon

[57] ABSTRACT

A lighting panel used to control locally unidirectional light is constructed from a plurality of light modifying elements that substantially control the distribution of light within a control range. Each element is disposed in the panel to receive the unidirectional light and has a surface means for critically reflecting the received light and for refracting the initially reflected light upon leaving the elements into the control range.

8 Claims, 9 Drawing Figures

LIGHTING PANEL WITH CONTROLLED DISTRIBUTION OF POLARIZED LIGHT

CROSS-REFERENCE TO RELATED APPLICATIONS

This application is related to application Ser. No. 473,857, "A LUMINAIRE HAVING A RADIAL POLARIZING STRUCTURE", filed May 28, 1974, by James D. Howe and Eugene C. Letter, now U.S. Pat. No. 3,912,921, issued Oct. 14, 1975, and is a continuation-in-part of application Ser. No. 542,526, "A LIGHTING PANEL WITH POLARIZING MEANS", filed Jan. 20, 1975 by Thomas W. Dey, both applications having a common assignee.

BACKGROUND OF THE INVENTION

In the lighting industry one of the methods used to improve the contrast at the task surface involves controlling the distribution of light. Normally a fluorescent lamp provides the light in a luminaire using such a method, and the distribution of light is controlled by positioning a lighting panel between the fluorescent lamp and a task surface. An example of a lighting panel embodying such an implemented method is illustrated in U.S. Pat. No. 3,794,289, issued to I. G. Taltavull. Such a lighting panel critically reflects the undesired portion of light and refracts the desired portion of light within a control range. A difficulty with such a lighting panel is that the panel is not efficient in that it does not directly use the undesired portion of light. Accordingly, such a panel can not operate at optimum efficiency.

A more recent development in the lighting industry is a device for radially polarizing substantially collimated light and then radially refracting the polarized light. Such a device has the advantage of improving the contrast at the task surface to obtain relatively high efficiency, thereby permitting a lesser amount of light to be used while providing sufficient working illumination at the task surface. An example of such a device is set forth in related application Ser. No. 473,857, now U.S. Pat. No. 3,912,921.

SUMMARY OF THE INVENTION

This invention relates generally to a luminaire for improving the contrast at a task surface by controlling the distribution of light within a control range. Control is accomplished by disposing a lighting panel across a reflector aperture. The reflector provides locally unidirectional light at the reflector aperture. The lighting panel is constructed from a plurality of light modifying elements. Each element is disposed to receive the locally unidirectional light and structured for critically reflecting received locally unidirectional light and for refracting the critically reflected light upon leaving the element into a control range.

Also devised is an apparatus to provide radially polarized light (linearly polarized and radially distributed light) from locally unidirectional light for use with a refracting element. A radial polarizing element constructed according to this invention, is in the form of a circular ring of triangular cross-section, which has the sides and apex of the triangular cross-section directed away from the locally unidirectional light. The radial polarizing element is formed within each refracting element and has a polarizing material disposed between the sides of the triangular cross-section and the refractor element. As the locally unidirectional light passes into the radial polarizing element, linearly polarized light will pass through the polarizing material and the remaining light will be reflected from one side to the other side of the triangular cross-section and then back toward the incoming collimated light. This circular ring of triangular cross-section shape permits radial distribution of the linearly polarized light passing through the polarizing material. The radially polarized light is then refracted, as with a refracting element that critically reflects the radially polarized light and then refracts the reflected light, or with a refracting element constructed in a manner similar to that described in related patent application Ser. No. 473,857.

BRIEF DESCRIPTION OF THE DRAWINGS

Objects and advantages of the invention will become apparent upon reading this description and upon reference to the drawings, in which like reference numerals refer to like elements in the various views.

DETAILED DESCRIPTION OF THE PREFERRED EMBODIMENT

Figure 1:
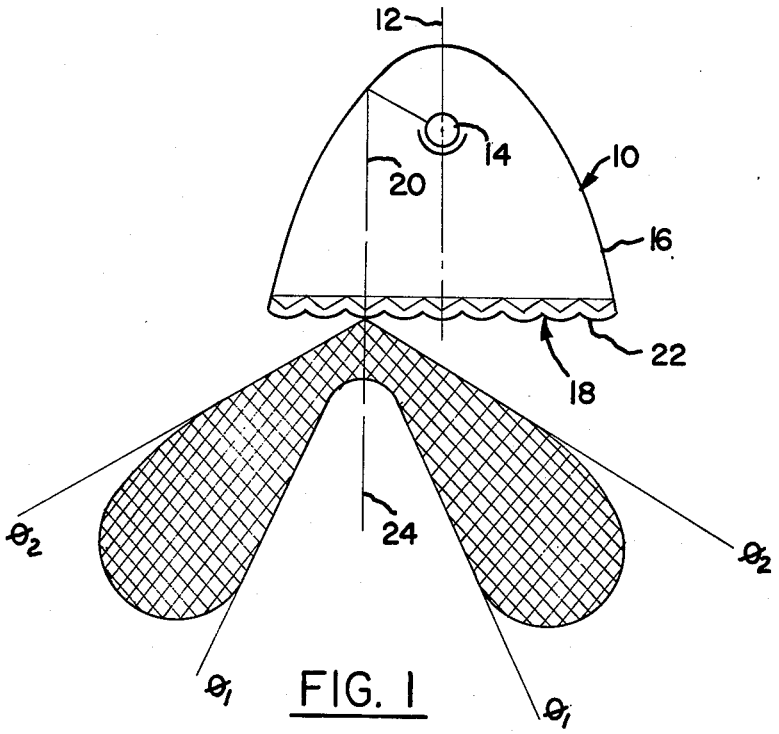
FIG. 1 is an elevational view, partly in section, of an embodiment of the invention showing the radial distribution of light from a single element.
Figure 4:
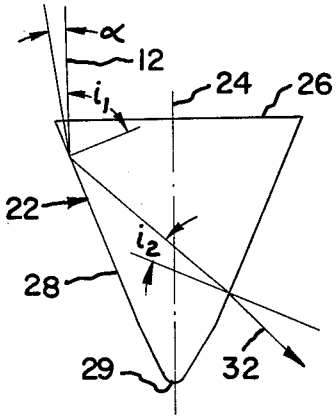
FIG. 4 is an elevational view of a single element of a second embodiment of the invention.

As best seen in FIG. 1, a luminaire 10 for providing controlled light distribution is illustrated. Luminaire 10 is constructed having an axis of symmetry 12, a high intensity discharge lamp 14 disposed centrally on the axis 12 and a reflector 16 disposed about lamp 14 to provide an aperture for the luminaire 10. A lighting panel 18 is positioned within the reflector's aperture to receive locally unidirectional light, represented by typical light ray 20 from the reflector 16. The lighting panel 18 is constructed relative to design reference axes 12', as seen in FIG. 4, which are substantially parallel to the axis of symmetry 12.

Locally unidirectional light is light passing through an incremental area of the reflector's aperture in a single direction. For example, the lamp 14 is a high intensity discharge lamp with the portion nearest panel 18 masked to prevent the direct passage of light from lamp 14 to panel 18. In the preferred embodiment, and as illustrated in the drawings, substantially collimated light is provided across the reflector's aperture by using a parabolic reflector 6. Substantially collimated light is defined as light rays limited to a maximum and minimum deflection of $\pm 25°$ from the design axis. There are several factors used to determine and control the amount of deflection of the substantially collimated light. One factor is the size of reflector 16 relative to the size of lamp 14. That is, there can be deflection of collimated light ray 20 as reflector 16 increases in size until lamp 14 becomes a relative point source of light. Another factor determining the amount of deflection is the shape of reflector 16, which may be slightly deviated from a parabolic shape, such as a slightly faceted parabolic reflector.

Figure 2:
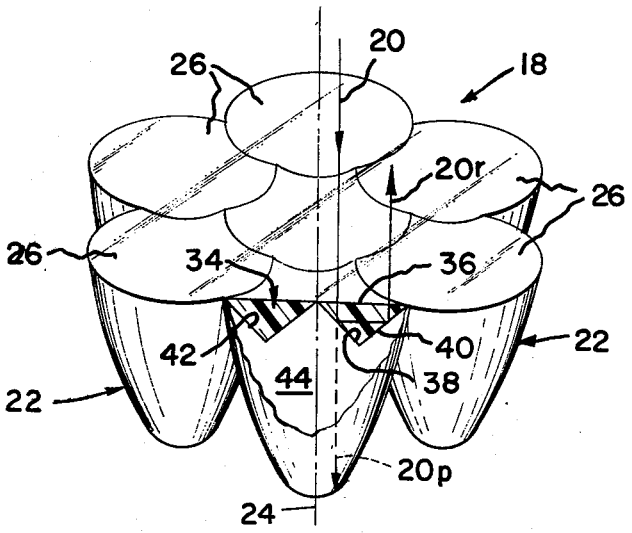
FIG. 2 is an enlarged perspective view of an array of light modifying elements embodying the invention.

As shown in FIG. 2, lighting panel 18 is constructed from an array of elements 22. As is best seen in FIGS. 3–8, the elements 22 may have different geometric configurations, but each has a base 26 disposed toward the incoming locally unidirectional light, an axis of symmetry 24, which is parallel to the design reference axes and a symmetrical surface 28 facing away from the incoming light and terminating in a tip 29. Preferably, base 26 is the incremental area through which the locally unidirectional light passes. As a locally unidirectional light ray 20 passes into each element 22, a light ray 30 results from critically reflecting light ray 20 from a first relative position on surface 28 and refracted light ray 32 is then caused by reflected light ray 30 passing through a second relative position on surface 28. The locations of the first and second relative positions on surface 28 are determined by the radial positioning of the typical light ray 20 relative to the symmetrical axis 24, the amount of deflection from design reference axis 12 and the shape of symmetrical surface 28. These factors determine the angle of incidence on the first and second positions on surface 28, which partially control light ray 32 within a control range as indicated between angles $\theta_1$ and $\theta_2$ (angles measured from design reference axis 12), as best seen in FIG. 1. The normal control range is with the minimum angle, $\theta_1$, equal to 25° and the maximum angle, $\theta_2$, equal to 60°. Another factor controlling light ray 32 within the control range is the index of refraction of the material to construct each element 22, which partially determines the amount of refraction upon leaving the element.

It has been determined that the aforementioned control factors are basically governed by two formulas. A second formula, Formula I, insures critical reflection and then refraction at symmetrical surface 28 of each element 22. A second formula, Formula II, insures that the range of the reflected light is substantially controlled between angles $\theta_1$ and $\theta_2$. Formula II is a "set" equation defining the range of values for $\theta$'s having the Greatest Lower Bound and the Least Upper Bound of $\theta_1$ and $\theta_2$, respectively. Formulas I and II are as follows:

$$\text{I: } i_1 > \arcsin(1/N) > |i_2|$$

$$\text{II: } \begin{array}{l} \{\theta\} \equiv \forall\ \theta \\ \theta = \alpha + \pi - 2i_1 + i_2 - \arcsin(N \sin i_2) \end{array}$$

$i_1$ = the angle of incidence of any selected locally unidirectional light ray 20 impinging on surface 28;
$i_2$ = the angle of incidence of reflected light ray 30 impinging on surface 28;
$N$ = index of refraction;
$\theta$ = the angle of deflection between any selected light ray 32 leaving element 22 and the design reference axis;
$\alpha$ = the angle of deflection between any selected unidirectional light ray 20 impinging on surface 28 and the design reference axis;
$\theta_1$ = the minimum deflection angle within the control range; and
$\theta_2$ = the maximum deflection angle within the control range.

Figure 3:
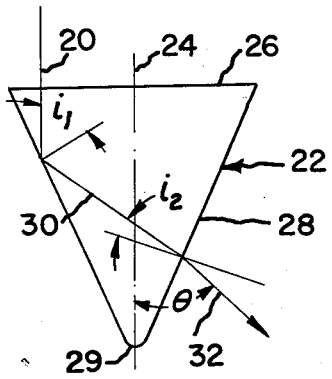
FIG. 3 is an elevational view of a single element of a one embodiment of the invention.

An illustrated example of the angle $\theta$ is shown in FIG. 3. In addition, an illustrated example of the angle $\alpha$ is shown in FIG. 4. Examples of the angles of incidence $i_1$ and $i_2$ are illustrated in FIGS. 3 and 4.

The aforementioned formulas have been used to design the specific embodiments illustrated by FIGS. 3–8. In addition, Formula III has been developed for use in obtaining a radius of curvature of curvilinear surface 28 of the embodiments illustrated by FIGS. 5–8. Formula III is as follows:

$$\text{III: } R = (h^2 + d^2/4)^{1/2}/2\tan((\theta_2 - \theta_1 - \alpha_{max} + \alpha_{min})/4)$$

$R$ = radius of curvature
$h$ = the distance from base 26 to tip 29 of each element 22;
$d$ = the diameter of base 26 of each element 22;
$\theta_2$ = the maximum deflection angle permissible within the control range;
$\theta_1$ = the minimum deflection angle permissible within the control range;
$\alpha_{max}$ = the maximum angle of deflection between the unidirectional light rays 20 impinging on surface 28 and the design reference axis; and
$\alpha_{min}$ = the minimum angle of deflection between the undirectional light rays 20 impinging on surface 28 and the design reference axis.

Figure 5:
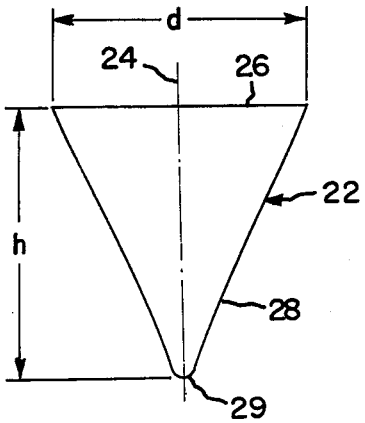
FIG. 5 is an elevational view of a single element of a another embodiment of the invention.
Figure 6:
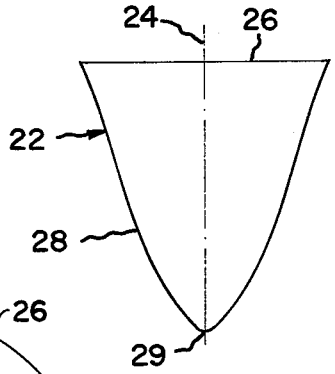
FIG. 6 is an elevational view of a single element of a further embodiment of the invention.
Figure 7:
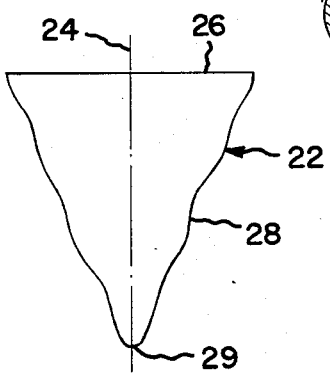
FIG. 7 is an elevational view of a single element of a an additional embodiment of the invention.
Figure 8:
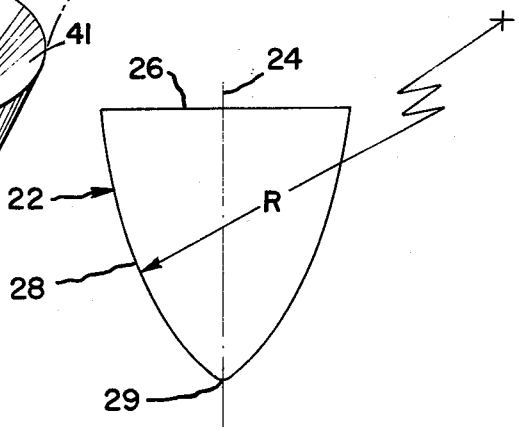
FIG. 8 is an elevational view of a single element of a still another embodiment of the invention.

Examples of the dimensions $h$ and $d$ are illustrated in FIG. 5. An example of the radius of curvature R is illustrated in FIG. 8. The radius of curvature of the embodiments illustrated by FIGS. 5–7 are not directly given by Formula III; however, the radius of curvature for these embodiments are obtained by dividing R by an integer representing the number of rises and falls of symmetrical side 28 from the median of symmetrical surface 28 extending from base 26 to tip 29 of each element 22.

As described heretofore, it is preferred to use a parabolic reflector to provide substantially collimated light at the reflector's aperture. Accordingly, the advantages in using lighting panels having the embodiments illustrated in FIGS. 3–8 are disclosed in relation to substantially collimated light.

The embodiment illustrated in FIG. 3 is a simple conical shaped member, which has as its main advantage the ease with which it can be manufactured. Also, the design parameters of the conical shaped member are easily specified because of the straight sides. However, a major disadvantage is the sensitivity of such a member to the amount of deflection from 0° collimation of substantially collimated light rays 20. That is, should the incoming collimated light rays 20 be of or close to 0° deflection then the light distribution will be sharply defined and a spread of light rays 32 between widely separated $\theta_1$ and $\theta_2$ is extremely difficult.

The embodiment of the invention illustrated in FIG. 4 is a compound conical shaped member. This embodiment has an advantage similar to the embodiment of FIG. 3, that of its relative ease of manufacture. A disadvantage is the extra scattering produced at the change between the angles of the two different conical shaped members and the erratic distribution of light similar to that described in relation to the embodiment illustrated in FIG. 3.

The embodiments illustrated in FIGS. 5, 6 and 7 all have the advantage that the distribution of reflected light rays 32 between $\theta_1$ and $\theta_2$ is relatively even. That is, there is no substantial difference in the distribution of light between $\theta_1$ and $\theta_2$. The radius of curvature of these surfaces is determined by the use of Formula III, as given above. A major disadvantage of these embodiments is that they are difficult to manufacture.

The embodiment illustrated in FIG. 8 has sides of a circular arc shape. This embodiment is designed to spread refracted light rays 32 between $\theta_1$ and $\theta_2$ independently of the degree of collimation of substantially collimated light ray 20. The radius of curvature of this embodiment is also governed by Formula III as given above. This circular arc embodiment has a disadvantage in that it prefers distributing refracted light rays 32 unevenly within the control range toward the lower angles, i.e., toward $\theta_1$.

Figure 9:
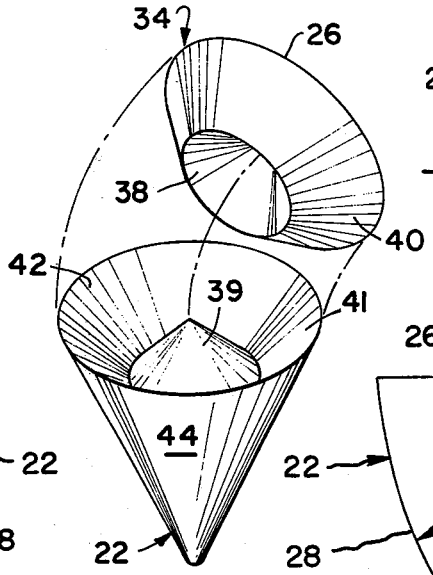
FIG. 9 is an exploded view of the polarizing and reflecting elements of FIG. 2.

As disclosed is related application Ser. No. 473,857, there are situations wherein it is desirable to radially polarize the locally unidirectional light. As best seen in FIGS. 2 and 9, there is devised a radial polarizing apparatus 34 capable of disposition within any light refracting apparatus or within one of the differently configured light modifying elements 22 of FIGS. 3–8. This radial polarizing device 34 is in the shape of a circular ring of triangular cross section. It can be described as a shaped body formed by rotating a triangular figure about an axis of rotation. As illustrated in FIG. 2, the circular ring can be formed by rotating the triangular cross-section about the vertex of one of its angles. Additionally, the shape of the radial polarizing device 34 can be visualized as a truncated cone having a conical portion removed from the inside of the cone with the base of the removed conical portion forming the truncated side of the truncated cone. The triangular cross section is circumscribed by a base 36, interior side 38 and exterior side 40. Interior side 38 and exterior side 40 taper at an angle of substantially 45° + 5° from base 36 to an apex. When radial polarizing apparatus 34, as best seen in FIG. 9, is to be disposed within each of the light modifying elements 22, as best seen in FIG. 2, base 26 of each element 22 is generated by triangular base 36 upon the rotation of the triangular cross section corner formed at the junction of interior side 38 and base 36 about axis of symmetry 24 when such corner is in juxtaposition to axis of symmetry 24. A polarizing material 42 for linearly polarizing collimated light, such as alternating layers of high and low index materials, is then disposed between sides 38 and 40 and refracting portion 44 of each light modifying element 22. It will be appreciated that in construction, the polarizing material 42 may be disposed upon either the outer tapered surfaces 38 and 40 of the polarizing device 34 or the respective mating surfaces 39 and 41 of the refracting portion 44 of each light modifying element 22. Refracting portion 44 of each light modifying element 22 is constructed with a surface such as that described in related application Ser. No. 473,857 or such as symmetrical surface 28 of each element 22.

The materials used in the construction of the lighting panel 16 either with or without radial polarizing apparatus 34 disposed within each element 22 are substantially the same as those materials disclosed in related application Ser. No. 473,857. Namely, the materials used in each element 22, without radial polarizing apparatus 34 disposed therein, may be a glass or plastic having an index of refraction from 1.40 to 2.0. The materials used in each element 22 with radial polarizing apparatus 34 disposed therein may be a nonbirefrigent glass or plastic having an index of refraction from 1.45 to 1.80 for the circular ring of triangular cross section, a glass or plastic having an index of refraction from 1.40 to 2.0 for refracting portion 44 of each element 22 and materials selected from the following table for polarizing material 42.

| | | | | | |
|---|---|---|---|---|---|
| High Index Material | ZnS | $TiO_2$ | $CeO_2$ | $ZrO_2$ | |
| Typical Index | 2.35 | 2.35 | 2.30 | 2.05 | |
| Low Index Material | $Na_5Al_3F_{14}$ | $Na_3A1F_6$ | $MgF_2$ | $SiO_2$ | Certain Glasses |
| Typical Index | 1.23–1.35 | 1.23–1.35 | 1.38 | 1.46 | 1.49 |

The determination of which material is to be used in constructing lighting panel 18 with radial polarizing apparatus 34 disposed in each element is set forth in detail in related application Ser. No. 473,857. Namely, the selection of the materials is governed by the relationship between the index of refraction of the selected materials. This relationship is governed by the Formulas IV and V as follows:

$$\underline{IV}: \sin A = \frac{N_L N_H}{N\,(\text{ring})\,(N_L^2 + N_H^2)^{\frac{1}{2}}}$$

$$\underline{V}: G_y = \frac{\lambda(N_H^2 + N_L^2)^{\frac{1}{2}}}{4N_y^2};$$

with

- sin A = angle of incidence of the light at polarizing material 42;
- $N$ (ring) = index of refraction of the circular ring of triangular cross section;
- $N_L$ = index of refraction of low index layer of polarizing material 42;
- $N_H$ = index of refraction of the high index layer of polarizing material 42;
- $G_y$ = thickness of a selected layer in polarizing material 42;
- $\lambda$ = median wavelength of the light being modified by each element 22;
- $N_y$ = index of refraction of the selected layer in polarizing material 42; and
- $y$ = selected layer of polarizing material 42, either L or H.

When radial polarizing apparatus 34 is disposed within each element 22, locally unidirectional light ray 20 passes into radial polarizing apparatus 34 to strike polarizing material 42. Light ray 20 is modified upon striking material 42 with a radially polarized light ray 20*p* transmitted through polarizing material 42 and a reflected light ray 20*r* reflected from one side of the triangular cross section to the other side and then back toward incoming locally unidirectional light ray 20. Radially polarized light ray 20*p* then passes into refracting portion 44 of each element 22. Refracting portion 44 may then refract radially polarized light ray 20*p* as described in related application Ser. No. 473,857 or radially polarized light ray 20*p* may be controlled, as locally unidirectional light ray 20 is, by critical reflection and then refraction at symmetrical surface 28 of each element 22, as aforementioned.

It is claimed:

1. A lighting panel for use in locally unidirectional light to distribute the light within a control range to improve illumination at a task surface, comprising:

radial polarizing means for linearly polarizing and radially distributing the locally unidirectional light; and light refracting means for critically reflecting substantially all of the radially polarized light and then refracting all the critically reflected light within a control range to provide improved illumination at a task surface.

2. A lighting panel for use in locally unidirectional light to distribute the light within a control range to improve illumination at a task surface, comprising:

radial polarizing means for linearly polarizing and radially distributing the locally unidirectional light;

light refracting means for critically reflecting the radially polarized light and then refracting the critically reflected light within a control range to provide improved illumination at a task surface; and a plurality of radial polarizing means and wherein said light refracting means includes a plurality of light modifying elements for critically reflecting and refracting the locally unidirectional light linearly polarized and radially distributed wherein each radial polarizing means is individually disposed within a respective light modifying element of said light refracting means for linearly polarizing and radially distributing the locally unidirectional light to each respective light modifying element wherein each said radial polarizing means is structured to define a ring having a triangular cross-section directed away from the locally unidirectional light, including a polarizing material disposed adjacent the sides of the ring of triangular cross-section for linearly polarizing the locally unidirectional light passing through to each of respective light modifying elements.

3. A lighting panel for use in locally unidirectional light to distribute the light within a control range to improve illumination at a task surface, comprising:

radial polarizing means for linearly polarizing and radially distributing the locally unidirectional light;

light refracting means for critically reflecting the radially polarized light and then refracting the critically reflected light within a control range to provide improved illumination at a task surface; and wherein said light refracting means includes a plurality of light modifying elements, each element having a design reference axis and a surface for critically reflecting the polarized light and then refracting the reflected polarized light, the surface of each element being constructed according to the design limits of $$i_1 > \arcsin(1/N) > i_2$$

$$\{\theta\} \equiv \theta \ \forall \rightarrow$$

$$\theta = \alpha + \pi - 2i_1 + i_2 - \arcsin(N \sin i_2)$$

wherein $i_1$ is the angle of incidence of any selected locally unidirectional light ray impinging on the surface;

$i_2$ is the angle of incidence of the reflected light ray of the selected locally unidirectional light ray impinging on the surface;

$N$ is the index of refraction of the material used in each element;

$\theta$ is the angle of deflection between the selected light ray leaving each element and the design reference axis;

$\alpha$ is the angle of deflection between the selected unidirectional light ray impinging on the surface and the design reference axis;

$\theta_1$ is the minimum deflection angle within the control range; and $\theta_2$ is the maximum deflection angle within the control range.

4. The lighting panel as defined in claim 3, including means for providing substantially collimated light as locally unidirectional light; and each light modifying element of said light refracting means has an axis of symmetry and the surface of each element is constructed in symmetry about the axis to critically reflect the polarized substantially collimated light and then refract the critically reflected light. and the axis of symmetry of each element lies substantially parallel to a design reference axis which is substantially parallel to the locally unidirectional light.

5. A light modifying apparatus for use with locally unidirectional light, comprising:

at least one light refracting element for spreading the light passing therethrough; and an optical element shaped in the form of a ring of triangular cross-section and disposed within each refracting element, the sides and apex of the ring of triangular cross-section directed away from the locally unidirectional light, and a nonbirefringent polarizing material disposed between the sides of the ring of triangular cross-section and the refracting element to radially polarizing the locally undirectional light prior to light entrance into each light refracting element.

6. The apparatus as defined in claim 5, wherein each refracting element has an axis of symmetry, has a surface symmetrical about the axis, and the surface faces away from the locally unidirectional light; and one vertex of the triangular cross-section of the ring is disposed in juxtaposition to the axis of symmetry of the refracting element.

7. A lighting panel used in substantially collimated light to distribute the light within a control range to improve illumination at a task surface, comprising:

radial polarizing means for linearly polarizing and radially distributing the substantially collimated light; and light refracting means for critically reflecting substantially all of the radially polarized light and then refracting all the critically reflected light within a control range to provide improved illumination at a task surface.

8. A lighting panel used in substantially collimated light to distribute the light within a control range to improve illumination at a task surface, comprising:

radial polarizing means for linearly polarizing and radially distributing the substantially collimated light; and light refracting means having an axis of symmetry and a surface for critically reflecting the radially polarized light and then refracting substantially all of the critically reflected light into a control range between 25° and 60° from the axis of symmetry to provide improved illumination at a task surface.

* * * * *

UNITED STATES PATENT AND TRADEMARK OFFICE

CERTIFICATE OF CORRECTION

PATENT NO. : 4,071,748

DATED : January 31, 1978

INVENTOR(S) : Thomas W. Dey

It is certified that error appears in the above-identified patent and that said Letters Patent are hereby corrected as shown below:

Col. 2, line 64, after "axis" insert --12--.

Col. 3, line 48, underline "I";
line 49, should read " $\{\theta\} \equiv \forall \theta \cdot 3 \cdot$ ".
line 50, underline "II".

Col. 4, line 13, underline "III".

Col. 6, line 15, underline "High Index Material";
line 16, underline "Typical Index";
line 17, underline "Low Index Material"; and
line 19, underline "Typical Index".

Col. 7, line 62, should read " $\{\theta\} \equiv \forall \theta \cdot 3 \cdot$ ".

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*